US006843176B2

(12) United States Patent
Ray et al.

(10) Patent No.: US 6,843,176 B2
(45) Date of Patent: Jan. 18, 2005

(54) METHOD TO REMOVE UNWANTED, UNEXPOSED, RADIATION-SENSITIVE LAYER IN A LITHOGRAPHIC PRINTING PLATE

(75) Inventors: Kevin B. Ray, Fort Collins, CO (US); Jianbing Huang, Trumbull, CT (US); Joanne Ray, Fort Collins, CO (US)

(73) Assignee: Kodak Polychrome Graphics, LLC, Norwalk, CT (US)

( * ) Notice: Subject to any disclaimer, the term of this patent is extended or adjusted under 35 U.S.C. 154(b) by 0 days.

(21) Appl. No.: 10/661,236

(22) Filed: Sep. 12, 2003

(65) Prior Publication Data

US 2004/0103806 A1 Jun. 3, 2004

Related U.S. Application Data

(63) Continuation-in-part of application No. 10/134,080, filed on Apr. 26, 2002, now Pat. No. 6,732,653.

(51) Int. Cl.[7] ..... B41N 3/00; B41C 1/10

(52) U.S. Cl. ..... 101/463; 101/401.1; 101/415.1; 101/467; 430/302; 430/330

(58) Field of Search ..... 101/401.1, 415.1, 101/463.1, 467; 430/302, 330

(56) References Cited

U.S. PATENT DOCUMENTS

| | | | | | |
|---|---|---|---|---|---|
| 4,799,085 | A | | 1/1989 | Nagumo | |
| 4,927,741 | A | * | 5/1990 | Garth et al. | 430/309 |
| 5,073,791 | A | | 12/1991 | Mouri et al. | |
| 5,340,699 | A | * | 8/1994 | Haley et al. | 430/302 |
| 5,345,870 | A | | 9/1994 | Bailey et al. | |
| 5,493,327 | A | * | 2/1996 | McCallum et al. | 347/262 |
| 5,631,120 | A | * | 5/1997 | Swirbel et al. | 430/326 |
| 5,699,740 | A | | 12/1997 | Gelbart | |
| 5,836,581 | A | | 11/1998 | Vernackt | |
| 5,962,192 | A | * | 10/1999 | Holman et al. | 430/302 |
| 6,003,442 | A | | 12/1999 | Solomon et al. | |
| 6,189,452 | B1 | | 2/2001 | Halup et al. | |
| 6,260,482 | B1 | | 7/2001 | Halup et al. | |
| 6,267,054 | B1 | | 7/2001 | Lopes | |
| 6,280,899 | B1 | | 8/2001 | Parsons et al. | |
| 6,295,929 | B1 | | 10/2001 | Tice et al. | |
| 6,599,676 | B2 | * | 7/2003 | Savariar-Hauck et al. | 430/270.1 |

FOREIGN PATENT DOCUMENTS

| | | |
|---|---|---|
| EP | 0741483 B1 | 8/2000 |
| EP | 1084842 A2 | 3/2001 |
| WO | WO 96/31807 | 10/1996 |

* cited by examiner

*Primary Examiner*—Daniel J. Colilla
*Assistant Examiner*—Jill E. Culler
(74) *Attorney, Agent, or Firm*—RatnerPrestia

(57) ABSTRACT

A method for forming a printing plate from a printing plate precursor having a radiation-sensitive layer, sensitive to radiation in a first frequency spectrum such as the far or near infrared, and to radiation in a second frequency spectrum other than the first frequency spectrum such as visible or ultraviolet. The plate is exposed twice. Once to imaging radiation in the first frequency spectrum and again to radiation in the second frequency spectrum. The second frequency spectrum exposure is done only to the areas of the plate undesirably shaded during the imagewise exposure.

26 Claims, 1 Drawing Sheet

METHOD TO REMOVE UNWANTED, UNEXPOSED, RADIATION-SENSITIVE LAYER IN A LITHOGRAPHIC PRINTING PLATE

CROSS-REFERENCE TO RELATED APPLICATIONS

This application is a continuation-in-part of application Ser. No. 10/134,080, filed Apr. 26, 2002 now U.S. Pat. No. 6,732,653, incorporated herein by reference.

FIELD OF THE INVENTION

The invention relates to lithographic printing plates. More particularly, it relates to methods for avoiding the need to remove unwanted, unexposed areas left on the finished plates due to shading of sections of the plate precursors by platesetter clamps or other plate-holding elements.

BACKGROUND OF THE INVENTION

In conventional or "wet" lithographic printing, ink-receptive regions, known as image areas, are generated on a hydrophilic surface. When the surface is moistened with water and ink is applied, the hydrophilic regions retain the water and repel the ink, and the ink-receptive regions accept the ink and repel the water. The ink is then transferred to the surface of a material upon which the image is to be reproduced. Typically, in a method known as "offset", this is done indirectly by first transferring the ink to an intermediate blanket, which in turn transfers the ink to the surface of the material upon which the image is to be reproduced.

A class of imageable elements called printing plate precursors, useful for preparing lithographic printing plates, comprises a layer applied over the surface of a hydrophilic substrate. The layer includes one or more radiation-sensitive components, which may be dispersed in a suitable binder. Alternatively, or in addition, the binder itself may be radiation-sensitive. The layer is commonly applied as a coating, using a solvent.

If after exposure to radiation the exposed regions of the coating are removed in the developing process, revealing the underlying hydrophilic surface of the substrate, the plate precursor is referred to as "positive-working". Conversely, if the unexposed regions are removed by the developing process and the exposed regions remain, the plate precursor is called "negative-working".

In both cases, the regions of the radiation-sensitive layer (i.e., the image areas) that remain are ink-receptive, and the regions of the hydrophilic surface revealed by the developing process accept water, typically a fountain solution, and repel ink.

An alternative way of achieving the same result is to begin with a hydrophilic surface upon which, after imagewise exposure and developing, an ink-receptive pattern representing the image is obtained. If the unexposed areas become ink receptive, the plate precursor is "positive-working", while if the exposed areas become ink receptive, it is "negative-working".

Recent developments in the field of printing plate precursors deal with radiation-sensitive compositions that can be imagewise exposed by lasers or laser diodes. Because lasers can be controlled by computers, this type of imaging, known as digital imaging, does not require films as intermediate information carriers.

High-performance lasers or laser diodes typically used in commercially available exposure devices (known as platesetters) emit in the wavelength ranges of either 800 to 850 nm or 1060 to 1120 nm. Therefore, printing plate precursors, or initiator systems contained therein, which are to be imaged by such platesetters, must be sensitive to the near infrared. They are not, however, typically very sensitive to visible light. Such printing plate precursors can therefore basically be handled under daylight conditions, which significantly facilitates their production and processing.

Thermally imageable elements useful as lithographic printing plate precursors, exposable by infrared lasers or laser diodes as described above, are becoming increasingly important in the printing industry. After imagewise thermal exposure, the rate of removal of the exposed regions by a developer in positive-working elements is greater than the rate of removal of the unexposed regions, so that the exposed regions are removed by the developer to form an image.

Printing plate precursors are also in use which are imageable by ultraviolet radiation, as are types that are imageable by visible radiation.

Imaging of digital, thermally imageable precursors is typically done using platesetters, where the plate precursor is mounted either i). on a rotatable drum (external drum), typically using clamps, or ii). in a drum (internal device), in which case the plate precursors are held in place with compressed air or with clamps, which may be magnetic.

When a positive-working lithographic printing plate precursor is imaged on a platesetter employing clamps, the clamping device prevents the successful exposure of the coating immediately under the clamp. After development, this unexposed area of coating accepts ink. Unless this section of coating is removed manually (a time-consuming process), it will cause an unwanted image on the press. The problem is particularly troublesome for web presses, where ink is wasted and unwanted inked image areas can transfer to the back of paper stocks.

In the case of a negative-working printing plate precursor, the unexposed areas are not ink receptive following development, so the above problem is absent. There is, however, often need in making a printing plate to extend solid printing image borders to the maximum permissible area of a plate. In such cases, the areas covered by the clamps cannot be used and represent wasted space.

Rather than using clamps, some platesetters employ suction cups and powerful vacuums. On mounting a plate precursor on such a platesetter, however, at least one edge of the plate precursor is typically inserted into a crevice in the drum, where it is shaded from the imaging radiation. In such systems, the presence of unwanted, remaining image areas is therefore still not avoided. Thus there remains a need for ways of either utilizing the areas covered by the clamps or avoiding the time-consuming step of removing such unwanted image areas after plate development.

SUMMARY OF THE INVENTION

These needs are addressed by the present invention. In one aspect, the invention is a method for forming a printing plate comprising a printing plate precursor comprising a radiation-sensitive layer, said radiation sensitive layer exhibiting sensitivity to radiation in a first frequency spectrum such as the far or near infrared, and to radiation in a second frequency spectrum other than said first frequency spectrum such as visible or ultraviolet, the method comprising imagewise exposing said printing plate precursor to said radiation in said first frequency spectrum and exposing to radiation in said second frequency spectrum any areas of said plate subject to undesirable shading during said imagewise exposure.

The undesirable shading is, typically, the result of applying clamping devices on the printing plate precursor to hold the precursor in place during the imagewise exposure. The printing plate precursor may be a positive working lithographic printing plate or a negative working lithographic printing plate. The plate precursor may be sensitive to heat and ultraviolet radiation or heat and visible radiation. Imaging may be accomplished by exposure to heating or to infrared radiation.

Still according to this invention, there is provided a method for forming a printing plate comprising a heat sensitive positive- or negative-working printing plate precursor that also exhibits sensitivity to visible or ultraviolet radiation. The method comprises exposing by imagewise heating the printing plate precursor and also exposing to visible or ultraviolet radiation (depending on the plate exhibited sensitivity) any areas of the precursor that were undesirably shaded during the imagewise heating exposure of the precursor usually due to the presence of clamps holding the plate precursor in place for the imagewise exposure. The exposure to the visible or ultraviolet radiation of the shaded areas may be done before, during or following the imagewise exposure of the precursor but before development.

In another aspect, the invention is a method for forming a printing plate, the method comprising the steps of:

(a) exposing a printing plate precursor comprising a radiation sensitive layer over a support with radiation in a first frequency region and forming exposed and unexposed regions in the radiation sensitive layer, in which the radiation sensitive layer exhibits sensitivity to radiation in the first frequency region and to radiation in a second frequency region, and the first frequency region and the second frequency region are not the same;

(b) exposing at least one of the unexposed regions with radiation in the second frequency region, and forming at least one additional exposed region; and (c) developing the printing plate precursor with a developer to form the printing plate.

DETAILED DESCRIPTION OF THE INVENTION

Figure 2:
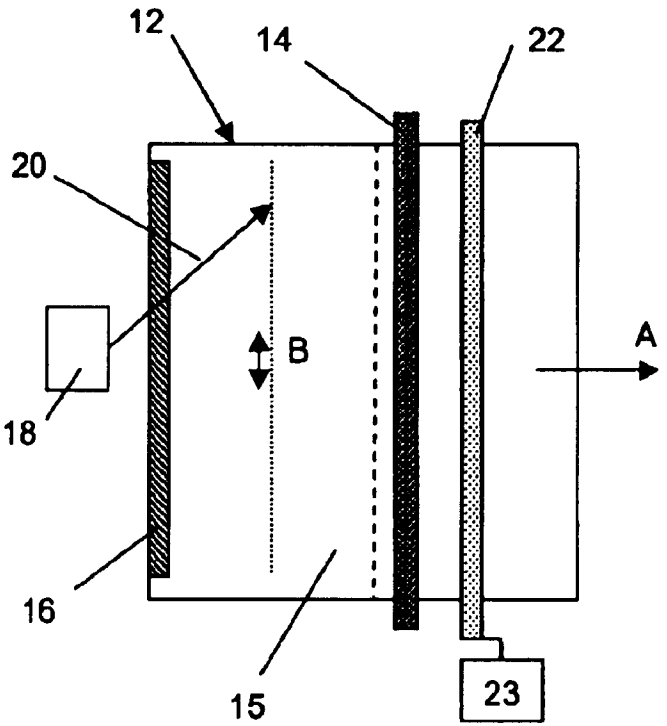
FIG. 2 shows a plan view of the device illustrated in FIG. 1.

The invention will next be described in detail with reference to a positive-working lithographic printing plate. However, this detailed description is only intended to illustrate the invention and the same method is also applicable to negative-working plates as hereinafter discussed.

One process of producing a printing plate from a positive-working printing plate precursor involves providing a precursor, imagewise exposing it to radiation designed to make exposed parts of the radiation-sensitive layer soluble or dispersible in a developer, and using the developer to produce a finished plate. In the present invention, unwanted unexposed areas can also be rendered soluble or dispersible through selective heating, or through avoiding their formation altogether via the use of plate-holding elements that are substantially transparent to the exposing radiation. Each of these elements will be discussed in detail below.

Printing Plate Precursors

A variety of printing plate precursors, or imageable elements, is available commercially. Depending on the type of precursor, the imaging radiation is commonly visible radiation, ultraviolet radiation, or infrared radiation, with precursors of this last type also being called "thermal" plate precursors. Single layer, positive working elements are disclosed in, for example, West, U.S. Pat. No. 6,090,532; Parsons, U.S. Pat. No. 6,280,899; McCullough, U.S. Pat. Pub. No. 2002/0136961; and WO99/21715, the disclosures of which are all incorporated herein by reference. Multilayer, positive working elements are disclosed in Shimazu, U.S. Pat. No. 6,294,311, U.S. Pat. No. 6,352,812, and U.S. Pat. No. 6,593,055; Patel, U.S. Pat. No. 6,352,811; and Savariar-Hauck, U.S. Pat. No. 6,358,669, and U.S. Pat. No. 6,528,228; the disclosures of which are all incorporated herein by reference. Negative working imageable compositions that comprise an acid generator, an acid activatable crosslinking agent, a polymeric binder, and a photothermal conversion material, are disclosed, for example, in Haley, U.S. Pat. No. 5,372,907; Nguyen, U.S. Pat. No. 5,919,601; Kobayashi, U.S. Pat. No. 5,965,319; Busman, U.S. Pat. No. 5,763,134; and WO 00/17711, the disclosures of which are all incorporated herein by reference. Negative working imageable compositions that comprise a photothermal conversion material, an initiator system capable of producing free radicals, and a polymerizable monomer are disclosed in Hauck, U.S. Pat. No. 6,309,792, the disclosure of which is incorporated herein by reference.

Thermal plate precursors are characterized by the presence of a "photothermal conversion material" which absorbs the imaging radiation and converts it to heat, causing imaged areas of the precursor to become soluble or dispersible in the developer. Photothermal conversion materials may absorb ultraviolet, visible, and/or infrared radiation to perform this function. Such materials are disclosed in numerous patents and patent applications, including Nagasaka, EP 0,823,327; DeBoer, U.S. Pat. No. 4,973,572; Jandrue, U.S. Pat. No. 5,244,771; Chapman, U.S. Pat. No. 5,401,618; and Hauck, U.S. Pat. No. 6,309,792. Examples of useful absorbing dyes include ADS-830 WS and ADS-1064 (both available from American Dye Source, Montreal, Canada), EC2117 (available from FEW, Wolfen, Germany), CYASORB® IR 99 and CYASORB® IR 165 (both available from Glendale Protective Technology), EPOLITE® IV-62B and EPOLITE® III-178 (both available from the Epoline), PINA-780 (available from the Allied Signal Corporation), SpectraIR 830A and SpectraIR 840A (both available from Spectra Colors), as well as IR Dye A, and IR Dye B, whose structures are shown below.

IR DYE A

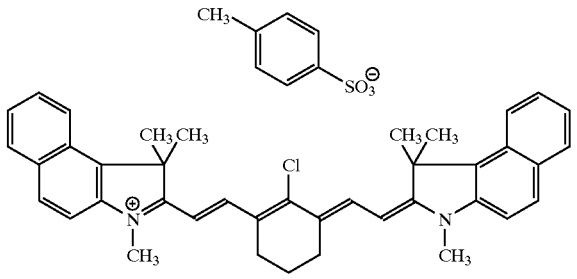

IR DYE B

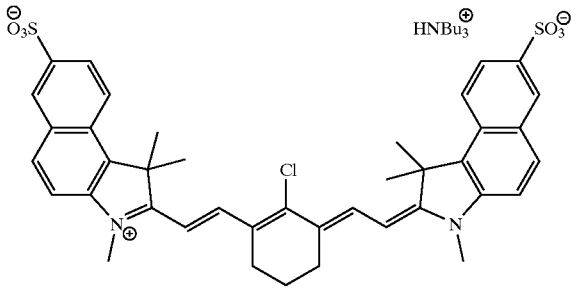

Positive working plate precursors useful for this invention include single-layer thermal plate precursors, which are a preferred embodiment. These are commercially available under such trade names as ELECTRA® and ELECTRA® EXCEL, available from Kodak Polychrome Graphics. Also preferred are multi-layer systems in which the photothermal conversion material resides in the bottom layer. Such a system is commercially available under the trade name SWORD™, available from Kodak Polychrome Graphics.

These printing plate precursors comprise a hydrophilic substrate, an underlayer on the substrate which comprises a developer-soluble or developer-dispersible polymer and a photothermal conversion material, and a top layer that is not soluble or dispersible in the developer. The top layer comprises an ink-receptive polymeric material, known as the binder, and a dissolution inhibitor. Preferred binders are phenolic resins; more preferred are novolac resins.

Dissolution inhibitors have polar functional groups that are believed to act as acceptor sites for hydrogen bonding with the hydroxyl groups present in the binder. Useful polar groups for dissolution inhibitors include, for example, diazo groups; diazonium groups; keto groups; sulfonic acid ester groups; phosphate ester groups; triarylmethane groups; onium groups, such as sulfonium, iodonium, and phosphonium; groups in which a nitrogen atom is incorporated into a heterocyclic ring; and groups that contain a positively charged atom, especially a positively charged nitrogen atom, typically a quaternized nitrogen atom, i.e., ammonium groups. Compounds that contain a positively charged (i.e., quaternized) nitrogen atom useful as dissolution inhibitors include, for example, tetraalkyl ammonium compounds, and quaternized heterocyclic compounds such as quinolinium compounds, benzothiazolium compounds, pyridinium compounds, and imidazolium compounds. Compounds containing other polar groups, such as ether, amine, azo, nitro, ferrocenium, sulfoxide, sulfone, and disulfone may also be useful as dissolution inhibitors.

Alternatively, or additionally, the polymeric material may comprise polar groups and act as both the binder and dissolution inhibitor, for example a novolac resin that contains a polar group, such as a diazonaphthoquinone moiety or a diazobenzoquinone moiety. When the polymeric material acts as both the binder and dissolution inhibitor, a separate binder and/or dissolution inhibitor may or may not be present. Derivatization of phenolic resins with compounds that contain the diazonaphthoquinone moiety is well known and is described, for example, in West, U.S. Pat. Nos. 5,705,308, and 5,705,322. The diazonaphthoquinone moiety and diazobenzoquinone moiety can be covalently attached through the phenolic hydroxyl groups of the binder using a reactive derivative such as 2-diazo-1,2-dihydro-1-oxo-5-naphthalenesulfonyl chloride and 2-diazo-1,2-dihydro-1-oxo-4-naphthalenesulfonyl chloride.

Also useful for this invention are 2-layer thermal plate precursors in which the photothermal conversion material resides in the top layer. These are described for instance by Van Damme, EP-0-864-420-A1 and Verschueren, EP-0-940-266-A1.

Three-layer thermal plate precursors are also useful, such as are described in U.S. appl. Ser. No. 09/999,587, incorporated herein by reference. Such systems comprise a hydrophilic substrate, an underlayer on the substrate which comprises a developer-soluble or developer-dispersible polymer and a photothermal conversion material, a barrier layer to prevent the photothermal conversion material from migrating, comprising a developer-soluble or developer-dispersible polymer, and a top layer comprising a polymer that is not soluble or dispersible in the developer.

Three layer thermal plate precursors are also described in Shimazu, U.S. Pat. No. 6,593,055, incorporated herein by reference. These systems comprise a hydrophilic substrate, an underlayer on the substrate which comprises a developer-soluble or developer-dispersible polymer and a photothermal conversion material, an absorber layer that consists essentially of the photothermal conversion material, and a top layer comprising a polymer that is not soluble or dispersible in the developer.

Also useful for this invention are 2-layer visible light sensitive plate precursors, of which a number of types are well known and commercially available.

Also useful in this invention are negative working, thermal plate precursors that are sensitive to both ultraviolet/visible and infrared radiation. These precursors comprise an imageable layer over a substrate.

In one type of negative working, thermal plate precursor, the imageable layer comprises a photothermal conversion material, an acid generator, an acid activatable crosslinking agent, and a polymeric binder. The acid generators include precursors that form a Brönsted acid by thermally initiated decomposition. Non-ionic acid generators include haloalkyl-substituted s-triazines, such as 2-phenyl-4,6-bis (trichloromethyl)-s-triazine. Ionic acid generators include onium salts such as diphenyl iodonium chloride, triphenyl sulfonium hexafluoroantimonate, triphenyl sulfonium tetrafluoroborate, 2-methoxy-4-aminophenyl diazonium hexafluorophosphate, 4,4'-dicumyl iodonium p-tolyl sulfate, and 2-methoxy-4-(phenylamino)-benzenediazonium octyl sulfate. Haley, U.S. Pat. No. 5,372,907, discloses a radiation-sensitive composition in which a novolac resin is the polymeric binder and a resole resin is the acid activatable crosslinking agent. Nguyen, U.S. Pat. No. 5,919,601, discloses radiation-sensitive compositions in which the polymeric binder contains reactive pendant groups selected from hydroxy, carboxylic acid, sulfonamide, and alkoxymethylamides; and the polymeric resin is a resole resin, a $C_1$–$C_5$ alkoxymethyl melamine or glycoluril resin, a poly($C_1$–$C_5$- alkoxy-methylstyrene), a poly($C_1$–$C_5$-alkoxymethylacrylamide), a derivative thereof, or a combination thereof.

In another type of negative working, thermal plate precursor, the imageable layer comprises a photothermal conversion material, an initiator system capable of generating free radicals on either thermal or ultraviolet exposure, a free radical polymerizable monomer, and, preferably, a binder. These systems are disclosed in Hauck, U.S. Pat. No. 6,309,792.

Another type of printing plate precursor suitable for use with this invention is described by Watkiss in U.S. Pat. No. 4,859,290. In such a system, unexposed silver halide diffuses to the surface of an aluminum substrate bearing nuclei capable of reducing the silver halide to metallic silver, which forms the basis for an oleophilic region on the developed plate. In this system, the silver halide in exposed areas is incapable of such diffusion and thus does not render the substrate oleophilic. According to the present invention, such immobilization of the silver can also be achieved by heating unexposed sections of the precursor.

Although the above-mentioned systems are the most common, the invention is applicable to radiation-sensitive positive-working systems irrespective of the number of layers employed in the plate precursor, and irrespective of whether the hydrophilic areas of the finished plate are formed by removal of hydrophobic material or by preventing the conversion of hydrophilic areas to ink-receptive ones. In general, these precursors are all employed in their routine manner of use, except where explicitly deviated from for the purposes of the invention.

Imaging

Imaging of the precursors can be performed with commercially available exposure devices, also known as platesetters. For thermal systems, for example, a CREO TRENDSETTER® 3244, supplied by CreoScitex Corporation, Burnaby, Canada; a PlateRite model 4300, model 8600, or model 8800, supplied by Screen, Rolling Meadows, Ill.; or a Gerber Crescent 42T, supplied by the Gerber Corporation, may be used. Many others are available, and any of these is applicable. The platesetter is used according to normal procedures for the unit, except where explicitly deviated from for the purposes of the invention. Typical exposure conditions for thermal plate precursors are given in the Examples.

For platesetters using visible light, commercial units include PlateRite from Screen, Rolling Meadows, Ill.; LaserStar from Krause, Branford, Conn.; Antares 1600 from Cymbolic Sciences, Blaine, Wash.; Galileo from Agfa, Wilmington, Mass.; and Lithosetter III from Barco Graphics, Vandalia, Ohio.

When the printing plate precursors are positive working, meaning that the radiation-sensitive composition is ultimately removed from areas exposed to the imaging radiation, the composition in those areas is converted to a form that is more easily soluble or dispersible in the developer than it is in the unexposed areas. In the case of infrared-sensitive plate precursors, heating of the exposed areas causes this change, and is usually performed by the action of an infrared laser during the imaging process. If the plate-holding elements are largely opaque to the infrared radiation, areas of the precursor under them do not get heated and therefore cannot normally be removed during developing.

Positive working thermally imageable single layer and multi-layer printing plate precursors are imaged by imaging a layer that comprises a binder and a dissolution inhibitor. Certain polar group containing moieties that are used in dissolution inhibitors are also sensitive to radiation in a second frequency spectrum, such as ultraviolet radiation, that is radiation in the wavelength range from 10 to 400 nm, more especially UV-A (320 to 400 nm). However, any printing plate precursors in which the dissolution inhibitor comprises a group that is sensitive to ultraviolet radiation may be used in this method. These include for example, haloalkyl-substituted s-triazines, such as are described, for example, in Smith, U.S. Pat. No. 3,779,778; and onium salts in which the onium cation is iodonium, sulphonium, or diazonium, such as are listed in Kobayashi, U.S. Pat. No. 5,965,319, especially iodonium, sulfonium, and diazonium salts in which the anion is an organic sulfate or thiosulfate, such as are disclosed in U.S. Pat. Appln. Ser. No. 10/155,696; filed: May 24, 2002. Printing plate precursors in which the dissolution inhibitor comprises a diazonaphthoquinone moiety or a diazobenzoquinone moiety are preferred.

In general this invention contemplates a process for making a printing plate using a precursor sensitive to two distinct radiation frequencies such as a precursor sensitive to infrared radiation comprising a heat sensitive layer that is also sensitive to a second frequency radiation, such as visible or ultraviolet radiation.

In practice, a plate precursor intended to be used for thermal imaging in an exposure device that involves holding the precursor in place during imagewise exposure with some form of plate holding clamp that is non transparent (opaque) to the exposing radiation, may be first masked using a ultraviolet radiation opaque mask designed to cover the image area and leave uncovered the area that will end up under the holding elements of the exposing device. Once masked the precursor is next exposed to ultraviolet radiation typically in a standard UV exposure vacuum frame. Once so exposed the mask is removed and the precursor mounted on the imaging exposure device for thermal imaging, usually through an infrared laser source.

Alternatively, the precursor may be first thermally exposed imagewise, and then, after removing the holding elements and masking the imaged area, exposed to ultraviolet radiation.

Another possibility, useful where the exposing source is able to generate both the infrared imaging radiation and the ultraviolet radiation, is the use of ultraviolet transparent materials for the holding element, so that the plate may be exposed to both the IR and UV radiation while in place on the exposure device.

The transparent plate-holding elements are constructed of materials that are substantially transparent to the imaging radiation; such materials are well known in the art. Suitable materials of construction of the plate-holding elements include, but are not limited to, most grades of clear glass, polymethyl methacrylate, polycarbonate, polyvinyl chloride, glass fiber-reinforced polyester, magnesium fluoride, barium fluoride, calcium fluoride, potassium bromide, and lithium fluoride. Also useful are thallium halides, especially mixtures such as 1) about 40 wt % thallium bromide and about 60 wt % thallium iodide, and 2) about 30 wt % thallium bromide and about 70 wt % thallium chloride. Also useful are chalcogenide glasses, polycrystalline zinc selenide, zinc sulfide, and lanthanide sulfides, fused silica (isotropic silicon dioxide), quartz and UVT acrylic from Polymer Plastic Corporation of Reno, Nev.

Yet another alternative is the use of a virtual mask rather than an actual mask. Such virtual mask may be easily created when the ultraviolet radiation is applied to the precursor through a scanning system that scans a modulated exposing spot across the precursor as for example when using a platesetter. This process is particularly advantageous where such platesetter has the ability to provide both the infrared and the ultraviolet radiation, as mentioned above.

Figure 1:
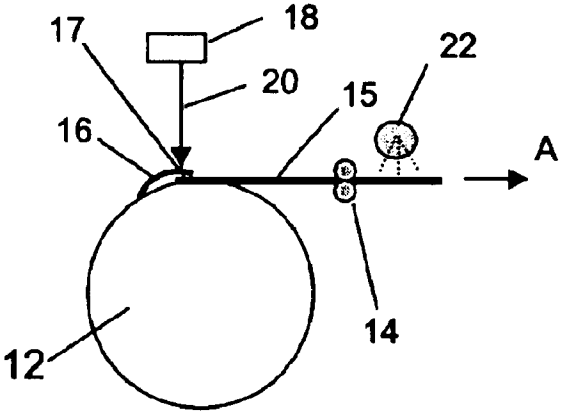
FIG. 1 is a schematic elevation representation of a platesetter to which has been added a second exposure device in accordance with one embodiment of this invention.

Yet another embodiment for conducting UV or visible light exposure of the lead and trailing edges of a digital plate in accordance with the present invention, is schematically illustrated in FIGS. 1 and 2. As shown a high-intensity fluorescent tube 22 is placed at the exit point of a platesetter. The typical platesetter elements are schematically represented as a supporting drum 12, a clamp 16 for holding an edge 17 of a printing plate precursor 15 to be imaged in place on the drum 12, and a laser exposure source 18 emitting a modulated exposing beam 20 for the image wise exposure of the plate 15. A scanning mechanism not illustrated is used to scan the exposing beam 20 across the plate surface as shown in FIG. 2 along an exposure line "B". The plate transits the exposure zone as it moves along arrow "A". A pair of guide rollers 14 is shown to represent the platesetter exit. A UV light source such as a fluorescent light bulb is placed at the platesetter exit to focus the emitted light into a narrow line on the surface of the imaged plate moving in a direction perpendicular to the focused light line. This focused light line can be turned on and off via the power supply control 23 or via a shutter such that only the lead and trailing edges of the plate are exposed. Alternatively, such UV or visible exposure assembly can be placed at the exit of a platesetter or at the entrance of a processor.

As mentioned above, this method of exposing the portions of a printing plate precursor to radiation of a frequency different than the imagewise exposing radiation is not limited to cases where the plate precursor is positive working. While the necessity for exposing the shaded areas in the case of negative-working plates is not as common as for positive-working plates, because the unexposed areas are hydrophilic to start with and therefore do not print, there are certain occasions where it is desirable to render such shaded areas ink receptive. This is true, for example, in instances where the imaged area contains a solid border. In such case, the portion of a plate held under a non transparent clamp is unusable. By using the process of this invention and exposing that portion of the plate as described above, the solid image borders are extended through the otherwise unusable area of the plate.

Developing of the exposed precursors to form the finished plates is performed with commercially available developers designed for the type of plate precursor being used. Many types are available, and their selection and use is well known in the art. Essentially any developer normally suitable for use with a particular plate precursor is suitable for use in the practice of this invention. In general, normal procedures are used unless specific mention is made to the contrary.

EXAMPLES

In the Examples that follow, "leading edge" means this edge was the first edge to be transported into the imagesetter, and "trailing edge" means the edge that was last transported into the imagesetter.

GLOSSARY

| | |
|---|---|
| 956 Developer | Solvent based (phenoxyethanol) developer (Kodak Polychrome Graphics, Norwalk, CT) |
| Binder A | Copolymer of N-phenylmaleimide, methacrylamide, and methacrylic acid (45:35:20 mol %) |
| BYK-307 | Polyethoxylated dimethylpolysiloxane copolymer (BYK Chemie, Wallingford, CT) |
| Basonyl Violet 610 | Crystal violet FN; Basic violet 3; CI 42555; Triarylmethane dye (lambda$_{max}$ = 588 nm) (Aldrich, Milwaukee, WI, USA) |
| CREO ® Trendsetter | Commercially available platesetter, using Procom Plus software and operating at a wavelength of 830 nm (Creo Products, Burnaby, BC, Canada) |
| Crystal Violet | Gentian Violet, C.I. 42555 (Aldrich, Milwaukee, WI) |
| DE85 | 2,4-dihydroxybenzophenone esterified with 215 naphthoquinonediazide sulfonate (ChemDesign, Fitchburg, MA) |
| Ethyl violet | C.I. 42600; CAS 2390-59-2 (lambda$_{max}$ = 596 nm) [(p-$(CH_3CH_2)_2NC_6H_4)_3C^+$ $Cl^-$] (Aldrich, Milwaukee, WI) |
| Extrema 830.1G | Positive working, thermally sensitive printing plate precursor (Lastra S.P.A., Manerbio, Italy) |
| Goldstar ™ Developer | 14% Aqueous sodium metasilicate pentahydrate developer (Kodak Polychrome Graphics, Norwalk, CT) |
| Greenstar ™ Developer | 7% Aqueous sodium metasilicate pentahydrate developer (Kodak Polychrome Graphics, Norwalk, CT |
| KF654B | 2-[2-[2-chloro-3-[(1,3-dihydro-1,3,3-trimethyl-2H-indol-2-ylidene)ethylidene]-1-cyclohexen-1-yl] ethenyl]-1,3,3-trimethyl-3H-Indolium bromide (Honeywell Specialty Chemicals, Morristown, NJ) |
| IR Dye A | Infrared absorbing dye (lambda$_{max}$ = 830 nm) (Eastman Kodak, Rochester, NY, USA) (see structure above) |
| LB6564 | Cresol/phenol novolac resin (Bakelite, Southampton, UK). |
| MSHDS | 2-Methoxy-4-(phenylamino)-benzenediazonium hexadecyl sulfate. |
| MSPF6 | Diazo MSPF6 (Diversitec Corporation, Fort Collins, CO) |

-continued

| GLOSSARY | |
|---|---|
| MSOS | 2-Methoxy-4-(phenylamino)-benzenediazonium octyl sulfate |
| P3000 | 215 Naphthoquinonediazide sulfonate ester of pyrogallol acetone condensate (PCAS, Longjumeau, France) |
| SD140A | Novolac resin, 75% m-cresol, 25% p-cresol; MW 7000 (Borden Chemical, Louisville, KY) |
| Substrate A | 0.3 gauge, aluminum sheet which had been electrograined, anodized and treated with a solution of polyvinylphosphonic acid |
| Triazine 980 | 1,3,5-Triacryloylhexahydro-s-triazine (TCI America, Portland, OR, USA) |
| Triazine A | 2-(4-Methoxyphenyl-4,6-bis(trichloromethyl)-s-triazine (PCAS, Longjumeau, France) |
| Triazine Y | 2-stilbenyl-4,6-bis(trichloromethyl)-s-triazine (Charkit, Darien, CT, USA) |
| Vinyl mask | Vinyl mask Anti-static, orange vinyl mask, about 125 microns (5 mil) thick (Precision Pre-press Products, Denver, CO) |

Comparative Example 1

This example illustrates formation, thermal imaging, and processing of a multi-layer printing plate precursor.

A coating solution containing 85 parts of Binder A and 15 parts of IR Dye A in 15:20:5:60 butyrolactone/methyl ethyl ketone/water/1-methoxypropan-2-ol (w:w) was coated onto substrate A with a wire wound bar. The resulting element consisting of an underlayer on a substrate was dried at 100° C. for 90 sec. Coating weight of the underlayer: 2.0 g/m$^2$.

A coating solution containing the ingredients listed in Table 1 in diethyl ketone was coated over the underlayer using a wire wound bar and dried at 100° C. at 90 sec. Coating weight of the top layer: 0.7 g/m$^2$.

TABLE 1

| Component | Parts by Weight |
|---|---|
| P3000 | 50 |
| SD140A | 49.15 |
| Ethyl Violet | 0.5 |
| BYK 307 | 0.35 |

The resulting printing plate precursor was imaged with the CREO® Trendsetter 3244 at 15 W, drum speed 85, 113 and 169 rpm, corresponding to an imaging energy density of 400, 300 and 200 mJ/cm$^2$, using a solid internal image pattern (100% exposure, plot 12). The imaged precursor was immersed in 956 developer using a model 85 NS processor.

There were unimaged, undeveloped areas around the lead and trailing edges of the precursor where the clamping device of the imagesetter covered the surface of the precursor, thus blocking exposure to the thermal laser. On a press, such unwanted areas on the resulting printing plate would produce a printed image. To eliminate such undesired areas, the plate would require manual treatment with a deletion method, adding manual steps to an otherwise completely automated process.

Example 1

This example illustrates simulation of an ultraviolet exposure device and mask used after thermal imaging using a positive working multi-layer precursor.

Comparative Example 1 was repeated, except that, following imaging the imaged precursor was masked off with the vinyl mask. An about a 3 cm strip of the trailing edge and the leading edge was not masked. Ultraviolet light from a lightframe was shone onto the edges for 120 sec. The mask was removed, and the imaged and exposed printing plate precursor developed as in Comparative Example 1. There were no unwanted, undeveloped regions on the resulting printing plate.

Example 2

This example illustrates simulation of an ultraviolet exposure device and mask before thermal imaging using a positive working multi-layer precursor.

Example 1 was repeated except that the precursor was masked with the vinyl mask and ultraviolet exposed before imaging. After the mask was removed, the precursor was imaged on the CREO® Trendsetter 3244, under the following conditions: 15 W, drum speed 169 rpm, corresponding to an imaging energy density of 200 mJ/cm$^2$, using a solid internal image pattern (100% exposure, plot 12). The imaged imageable element was immersed in 956 developer using the model 85 NS processor. There were no unwanted, undeveloped regions on the resulting printing plate.

Comparative Example 2

An Extrema 830.1G printing plate precursor (size 460×660×0.3 mm) was imaged on the CREO® Trendsetter 3244 under the following conditions: 8 W, drum speed 86 rpm, with an imaging energy density of 200 mJ/cm$^2$, using an solid internal image pattern (100% exposure, plot 12). The imaged precursor was immersed in Goldstar™ developer using a Mercury Mk V processor (developer temperature 25° C., throughput speed 750 mm/min). There were unexposed and undeveloped regions around the lead and trailing edges of the resulting printing plate, where the clamping device of the imagesetter covered the precursor surface, thus blocking exposure to the thermal laser.

Example 3

This example simulates the use of an ultraviolet transparent clamp after infrared imaging.

The procedure of Comparative Example 2 was repeated except that, just prior to processing, a block of quartz (4.5 cm deep, 1 cm wide, and 10.5 cm long) was placed upon the lead edge of the precursor, and ultraviolet light from a lightframe (Olec PA93 photocell, diazo photopolymer bulb, wide band ultraviolet (350 to 420 nm), Olix A1131 Integrator, Olec Corporation, Irvine, Calif.) was shone through the quartz block (through the 4.5 cm dimension) onto the top layer under the quartz block for 60 sec. The imaged precursor was processed as in Comparative Example 2. No unwanted regions remained on the resulting printing plate.

Example 4

This example simulates the use of an ultraviolet transparent clamp after infrared imaging.

The multi-layer printing plate precursor as described in Comparative Example 1 was imaged as in Comparative Example 1. Just prior to processing, a block of quartz (4.5 cm deep, 1 cm wide, 10.5 cm long) was placed upon the lead edge of the imaged precursor. Ultraviolet light from a lightframe (as in example 12) was shone through the quartz block (through the 4.5 cm dimension) onto the top layer under the quartz block for 120 seconds. The imaged precursor was processed as in Comparative Example 2. No unwanted regions remained on the resulting printing plate.

Comparative Example 3

A coating solution was prepared by dissolving 1.360 g of LB6564, 0.389 g of P3000, 0.039 g of Basonyl Violet 610, 0.069 g of KF654B and 0.004 g of BYK 307 in 28.14 g of 1-methoxypropan-2-ol. The coating solution was coated onto substrate A and the resulting element dried at 100° C. for about 90 sec in a Mathis LTE labdryer oven. Dry coating weight of imageable layer: about 1.5 g/m$^2$.

The resulting printing plate precursor was imaged on a CREO® Trendsetter 3244 under the following conditions: 15 W, drum speed 85, 113 and 169 rpm, corresponding to an imaging energy density of 400, 300 and 200 mJ/cm$^2$, using an solid internal image pattern (100% exposure, plot 12). The imaged precursor was then immersed in Goldstar™ developer using a Mercury Mk V processor (developer temperature 25° C., throughput speed 750 mm/min). The resulting printing plate had unexposed areas around the lead and trailing edges of the plate, where the clamping device of the imagesetter covered the surface, thus blocking exposure to the thermal laser.

Example 5

This example illustrates simulation of an ultraviolet exposure device and mask after infrared imaging.

The procedure of Comparative Example 3 was repeated, except that, after the precursor was imaged, it was masked off with anti-static, orange vinyl mask, except at the trailing and leading edges (each revealed edge comprised about a 3 cm strip). Ultraviolet light from a lightframe was shone onto the edges for 120 sec. The imaged precursor was processed as in Comparative Example 3. No unwanted regions remained on the resulting printing plate.

Example 6

This example illustrates simulation of an ultraviolet exposure device and mask used before infrared imaging.

The procedure of Comparative Example 3 was repeated, except that, before imaging the printing plate precursor was masked off with anti-static, orange vinyl mask, except at the trailing and leading edges (each revealed edge comprised about a 3 cm strip). Ultraviolet light from a lightframe was shone onto the edges for 120 sec. The mask was removed and the precursor imaged at an energy density of 200 mJ/cm$^2$, and developed as in Comparative Example 5. No unwanted regions remained on the resulting printing plate.

Examples 7 to 15

Coating solutions were prepared containing the components listed in Table 2 in 1-methoxypropan-2-ol. The coating solutions were coated onto substrate A by means of a wire wound bar and dried at 100° C. for 90 sec. Dry coating weight of the resulting layer: 1.5 g/m$^2$.

TABLE 2

| | Example | | | | |
|---|---|---|---|---|---|
| Component | 7 | 8 | 9 | 10 | 11 |
| LB6564 | 86 | 74 | 86 | 74 | 86 |
| MSHDS | 8 | 20 | — | — | — |
| MSPF6 | — | — | 8 | 20 | — |
| Triazine Y | — | — | — | — | 8 |
| Triazine 980 | — | — | — | — | — |
| Triazine A | — | — | — | — | — |
| Crystal Violet | 2.1 | 2.1 | 2.1 | 2.1 | 2.1 |
| KF654B | 3.7 | 3.7 | 3.7 | 3.7 | 3.7 |
| BYK307 | 0.2 | 0.2 | 0.2 | 0.2 | 0.2 |

| | Example | | | |
|---|---|---|---|---|
| Component | 12 | 13 | 14 | 15 |
| LB6564 | 74 | 86 | 74 | 86 |
| MSHDS | — | — | — | — |
| MSPF6 | — | — | — | — |
| Triazine Y | 20 | — | — | — |
| Triazine 980 | — | 8 | 20 | — |
| Triazine A | — | — | — | 8 |
| Crystal Violet | 2.1 | 2.1 | 2.1 | 2.1 |
| KF654B | 3.7 | 3.7 | 3.7 | 3.7 |
| BYK307 | 0.2 | 0.2 | 0.2 | 0.2 |

Each of the resulting printing plate precursors was imaged on a CREO® Trendsetter 3244 under the following conditions: 15 W, drum speed 85, 113 and 169 rpm, corresponding to an imaging energy density of 400, 300 and 200 mJ/cm$^2$, using an solid internal image pattern (100% exposure, plot 12). The samples were then immersed in Goldstar™ developer 30 sec. There were indicated unimaged and unremoved regions around the lead and trailing edges of the resulting printing plates, where the clamping device of the imagesetter covered the plate surface, thus blocking exposure to the thermal laser.

The procedure was repeated except that each of the imaged imageable elements was masked off with the vinyl mask, except at the trailing and leading edges after infrared imaging. Ultraviolet light from a lightframe was shone onto the edges for 120 sec. Each precursor was processed as above. No unwanted regions remained on the resulting printing plate.

The procedure was repeated except that, prior to imaging, each of the imageable elements was masked off with the vinyl mask, except at the trailing and leading edges. Ultraviolet light from a lightframe was shone onto the edges for 120 sec. Each precursor was imaged at 200 mJ/cm$^2$ and processed as above. No unwanted regions remained on the resulting printing plate.

Examples 16 and 17

Coating solutions were prepared containing the components given Table 3 in 1-methoxypropan-2-ol were coated onto substrate A by means of a wire wound bar and dried at 100° C. for 90 sec. Coating weight: 1.5 g/m$^2$.

TABLE 3

| Component | Example 16 | Example 17 |
|---|---|---|
| | Parts by Weight | |
| LB6564 | 84 | 79 |
| P3000 | 10 | 15 |
| Crystal Violet | 2.1 | 2.1 |
| KF654B | 3.7 | 3.7 |
| BYK307 | 0.2 | 0.2 |

The resulting imageable elements were imaged on the CREO® Trendsetter 3244, under the following conditions: 15 W, drum speed 85, 113 and 169 rpm, corresponding to an imaging energy density of 400, 300 and 200 ml/cm$^2$, using an solid internal image pattern (100% exposure, plot 12). The imageable elements were immersed in Goldstar™ developer for 30 sec. There were indicated unimaged and unremoved regions around the lead and trailing edges of the resulting printing plates, where the clamping device of the imagesetter covered the plate surface, thus blocking exposure to the thermal laser.

The procedure was repeated except that each of the imaged imageable elements was masked off with the vinyl mask, except at the trailing and leading edges after infrared imaging. Ultraviolet light from a lightframe was shone onto the edges for 120 sec. Each precursor was processed as above. No unwanted regions remained on the resulting printing plate.

The procedure was repeated except that, prior to imaging, each of the imageable elements was masked off with the vinyl mask, except at the trailing and leading edges. Ultraviolet light from a lightframe was shone onto the edges for 120 sec. Each precursor was imaged at 200 mJ/cm$^2$ and processed as above. No unwanted regions remained on the resulting printing plate.

Examples 18 to 22

Coating solutions were prepared containing the components given Table 4 in 1-methoxypropan-2-ol were coated onto substrate A by means of a wire wound bar and dried at 100° C. for 90 sec. Coating weight: 1.5 g/m$^2$.

TABLE 4

| COMPONENT | Example 18 | Example 19 | Example 20 | Example 21 | Example 22 |
|---|---|---|---|---|---|
| | Parts by Weight | | | | |
| LB6564 | 86 | 74 | 74 | 84 | 89 |
| MSOS | 8 | 20 | — | — | — |
| Crystal Violet | 2.1 | 2.1 | 2.1 | 2.1 | 2.1 |
| KF654B | 3.7 | 3.7 | 3.7 | 3.7 | 3.7 |
| BYK307 | 0.2 | 0.2 | 0.2 | 0.2 | 0.2 |
| DE85 | — | — | 20 | 10 | 5 |

The resulting imageable elements were imaged on the CREO® Trendsetter 3244, under the following conditions: 15 W, drum speed 85, 113 and 169 rpm, corresponding to an imaging energy density of 400, 300 and 200 ml/cm$^2$, using an solid internal image pattern (100% exposure, plot 12). The imageable elements were immersed in Goldstar™ developer for 30 sec. There were indicated unimaged and unremoved regions around the lead and trailing edges of the resulting printing plates, where the clamping device of the imagesetter covered the plate surface, thus blocking exposure to the thermal laser.

The procedure was repeated except that each of the imaged imageable elements was masked off with the vinyl mask, except at the trailing and leading edges after infrared imaging. Ultraviolet light from a lightframe was shone onto the edges for 120 sec. Each precursor was processed as above. No unwanted regions remained on the resulting printing plate.

The procedure was repeated except that, prior to imaging, each of the imageable elements was masked off with the vinyl mask, except at the trailing and leading edges. Ultraviolet light from a lightframe was shone onto the edges for 120 sec. Each precursor was imaged at 200 mJ/cm$^2$ and processed as above. No unwanted regions remained on the resulting printing plate.

Example 23

This example illustrates the synthesis of 2-methoxy-4-(phenylamino)-benzenediazonium octyl sulfate (MSOS).

64.0 g of 35% sodium octyl sulfate (Aldrich, Milwaukee, Wis., USA) in water was slowly added in 31.0 g of 2-methoxy-4-(phenylamino)-benzenediazonium bisulfate (Diversitec, Fort Collins, Colo., USA) in 500 ml of water with stirring. The resulting mixture was stored in the dark at 0–5° C. for 5 hours. After the water was decanted, the resulting oil was dissolved in 200 ml of ethyl acetate. The resulting solution was washed with 50 ml of 5% aqueous sodium bicarbonate and with 50 ml of water. The organic layer was dried over anhydrous magnesium sulfate for 6 hours and the solvent removed by vacuum. 35.1 g of oil was obtained.

Proton NMR (in acetone-$d_6$): δ 0.84 (3H,t), 1.22 (10H, m), 1.53 (2H, p), 3.88 (2H,t), 4.10 (3H,s), 6.50–7.60 (7H, m), 8.17 (1H, d), and 10.9 (1H,s).

Example 24

This example illustrates the synthesis of 2-methoxy-4-(phenylamino)-benzenediazonium hexadecyl sulfate (MSHDS).

3.25 g of 2-methoxy-4-(phenylamino)-benzenediazonium bisulfate (Diversitec, Fort Collins, Colo.) in 50 ml of water was neutralized with 0.8 g of sodium bicarbonate in 25 ml water. 3.45 g of sodium hexadecyl sulfate (TCI America, Portland, Oreg., USA) was dissolved in 150 ml of water at 50° C. The solution of the diazonium salt as slowly added to the hexadecyl sulfate solution with stirring. The reaction mixture was stored in the dark at 0–5° C. for 12 hours. The resulting precipitate was filtered off and dried in vacuum. Yield: 5.4 g.

Proton NMR (in acetone-$d_6$): δ 0.87(3H,t), 1.31 (26H, m), 1.58 (2H, m), 3.90 (2H, t), 4.15 (3H,s), 6.90–7.60 (7H, m), 8.19 (1H, d), and 11.10 (1H,s).

Having described the invention, we now claim the following and their equivalents.

What is claimed is:

1. A method for forming a printing plate precursor comprising a radiation-sensitive layer, said radiation sensitive layer exhibiting sensitivity to radiation in a first frequency spectrum and to radiation in a second frequency spectrum other than said first frequency spectrum, said precursor forming a printing plate following imagewise exposure in an exposure device to said radiation in said first frequency spectrum, wherein said imagewise exposure (i) generates imagewise exposed and unexposed areas of said plate and (ii) generates undesirably unexposed areas due to unwanted shading during said imagewise exposure, the method comprising identifying and pre-exposing to radiation in said second frequency spectrum prior to placing said precursor in said exposure device areas of said precursor undesirably unexposed during said imagewise exposure.

2. The method according to claim 1 wherein said printing plate is a positive working lithographic printing plate.

3. The method according to claim 1 wherein said printing plate is a negative working lithographic printing plate.

4. The method according to claim 1 wherein said undesirably unexposed areas result from applying a clamping device on said precursor during said imagewise exposure of said precursor.

5. The method according to claim 1 wherein said precursor is heat sensitive and said imagewise exposure comprises imagewise heating said plate precursor layer.

6. The method according to claim 5 wherein said heat sensitive precursor comprises a photothermal conversion material.

7. A method according to claim 1 wherein said first frequency radiation is heating radiation and said second frequency radiation is one of visible and ultraviolet radiation.

8. The method according to claim 7 further comprising, following said imagewise exposure, by developing said printing plate precursor.

9. The method according to claim 7 wherein said precursor comprises a photothermal conversion material.

10. The method according to claim 7 wherein said undesirably unexposed areas result from applying a clamping device on said precursor during said imagewise exposure of said precursor.

11. The method according to claim 1 for forming a printing plate, the method comprising the step of:

(a) developing the printing plate precursor with a developer to form the printing plate.

12. The method of claim 11 in which the first frequency region is in the ultraviolet, and the second frequency region is in the infrared.

13. The method of claim 11 in which the first frequency region is in the infrared, and the second frequency region in the ultraviolet.

14. The method of claim 11 wherein said exposure to radiation in said first and said second frequency spectra creates exposed regions on said precursor and wherein the exposed regions are removed by the developer.

15. The method of claim 11 wherein said exposure to radiation in said first and said second frequency spectra creates exposed regions on said precursor and wherein the unexposed regions are removed by the developer.

16. A method for forming a printing plate comprising a printing plate precursor comprising a radiation-sensitive layer, said radiation sensitive layer exhibiting sensitivity to radiation in a first frequency spectrum and to radiation in a second frequency spectrum other than said first frequency spectrum, the method comprising imagewise exposing said printing plate precursor to said radiation in said first frequency spectrum and exposing to radiation in said second frequency spectrum any areas of said plate subject to undesirable shading during said imagewise exposure as a result of applying a clamping device on said precursor during said imagewise exposure of said precursor, wherein said clamping device is transparent to said second frequency radiation.

17. The method according to claim 16 wherein said clamping device comprises clear glass, polymethyl methacrylate, polycarbonate, polyvinyl chloride, glass fiber-reinforced polyester, magnesium fluoride, barium fluoride, calcium fluoride, potassium bromide, lithium fluoride, thallium halides, chalcogenide glass, polycrystalline zinc selenide, zinc sulfide, lanthanide sulfides, fused silica, quartz, UVT acrylic or a combination thereof.

18. The method according to claim 16 wherein the undesirably unexposed areas of said plate are exposed to said radiation in said second frequency spectrum following the imagewise exposing of the precursor to the first frequency spectrum radiation.

19. The method according to claim 16 wherein the undesirably unexposed areas of said plate are exposed to said radiation in said second frequency spectrum during the imagewise exposing of the precursor to the first frequency spectrum radiation.

20. The method according to claim 16 wherein said first frequency spectrum radiation is heating radiation and said second frequency spectrum radiation is one of visible or ultraviolet radiation and wherein said clamping device is transparent to at least one of said visible or ultraviolet radiation.

21. The method according to claim 20 wherein said clamping device comprises clear glass, polymethyl methacrylate, polycarbonate, polyvinyl chloride, glass fiber-reinforced polyester, magnesium fluoride, barium fluoride, calcium fluoride, potassium bromide, lithium fluoride, thallium halides, chalcogenide glass, polycrystalline zinc selenide, zinc sulfide, lanthanide sulfides, fused silica, quartz, UVT acrylic, or a combination thereof.

22. The method according to claim 20 wherein the undesirably unexposed areas of said plate are identified and exposed to said at least one of visible or ultraviolet radiation prior to the step of exposing the precursor by imagewise heating.

23. The method according to claim 20 wherein the undesirably unexposed areas of said plate are identified and exposed to said at least one of visible or ultraviolet radiation during the step of exposing by imagewise heating the precursor.

24. The method according to claim 20 wherein the undesirably unexposed areas of said plate are identified and exposed to said at least one of visible or ultraviolet radiation following the step of exposing by imagewise heating the precursor.

25. A method for forming a printing plate comprising a heat sensitive printing plate precursor said precursor also exhibiting sensitivity to at least one of visible and ultraviolet radiation, the method comprising:

(a) exposing said printing plate precursor by imagewise heating in an imagesetter;

(b) exposing to at least one of said visible and ultraviolet radiation only areas of said plate undesirably shaded during said imagewise heating exposure of said precursor as said precursor exits said imagesetter following said exposure to imagewise radiation; and (c) developing said printing plate precursor.

26. The method according to claim 25 wherein said exposure to said at least one of visible and ultraviolet radiation is performed with a fluorescent light source positioned at an exit of said imagesetter and extending across said exit.

* * * * *

UNITED STATES PATENT AND TRADEMARK OFFICE

CERTIFICATE OF CORRECTION

PATENT NO. : 6,843,176 B2 
DATED : January 18, 2005
INVENTOR(S) : Kevin B. Ray, Jianbing Huang and Joanne Ray It is certified that error appears in the above-identified patent and that said Letters Patent is hereby corrected as shown below:

Column 17,
Line 27, delete "by developing" and insert -- developing --

Column 18,
Lines 10 and 15, delete "exposing of the" and insert -- exposing the --

Signed and Sealed this

Twenty-sixth Day of April, 2005

JON W. DUDAS
*Director of the United States Patent and Trademark Office*